US009617109B2

(12) United States Patent
Ota et al.

(10) Patent No.: US 9,617,109 B2
(45) Date of Patent: Apr. 11, 2017

(54) IMAGE RECORDING APPARATUS

(71) Applicant: BROTHER KOGYO KABUSHIKI KAISHA, Nagoya-shi, Aichi-ken (JP)

(72) Inventors: Yasuhira Ota, Yatomi (JP); Noriyuki Kawamata, Nagoya (JP); Motohiro Okamura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 10 days.

(21) Appl. No.: 14/670,147

(22) Filed: Mar. 26, 2015

(65) Prior Publication Data

US 2015/0274474 A1 Oct. 1, 2015

(30) Foreign Application Priority Data

Mar. 28, 2014 (JP) ..... 2014-068558

(51) Int. Cl.
*B65H 31/00* (2006.01)
*B65H 7/02* (2006.01)
(Continued)

(52) U.S. Cl.
CPC ..... *B65H 31/00* (2013.01); *B65H 1/04* (2013.01); *B65H 7/02* (2013.01); *B65H 29/14* (2013.01);
(Continued)

(58) Field of Classification Search
CPC ..... B65H 31/00; B65H 2405/1117; B65H 2405/11172; B65H 2405/1124;
(Continued)

(56) References Cited

U.S. PATENT DOCUMENTS 5,587,782 A * 12/1996 Johdai ..... G03G 15/60 271/227
7,382,998 B2 * 6/2008 Murrell ..... G03G 21/1638 399/107
(Continued)

FOREIGN PATENT DOCUMENTS

JP 2003-089249 A 3/2003
JP 2008-213946 A 9/2008
JP 2013-039797 A 2/2013

OTHER PUBLICATIONS

Notice of Reasons for Rejection issued in related Japanese patent application No. 2014-068558, mailed Jan. 4, 2017.

*Primary Examiner* — Michael McCullough
(74) *Attorney, Agent, or Firm* — Merchant & Gould P.C.

(57) ABSTRACT

An image recording apparatus includes: a casing; a sheet-feeder tray having a supporting surface for supporting a sheet-shaped recording medium; a recording unit which is configured to record an image on the recording medium fed from the sheet-feeder tray; a discharge roller pair configured to discharge, from the casing, the recording medium on which the image has been recorded by the recording unit; an opening-closing member which is provided on the downstream of the discharge roller pair in a direction in which the recording medium is discharged by the discharge roller pair and is rotatable between a first position where a discharging slot of the recording medium discharged by the discharge roller pair is closed and a second position where the discharging slot is open; and a restricting mechanism configured to restrict the rotation of the opening-closing member from the second position to the first position.

15 Claims, 6 Drawing Sheets

(51) Int. Cl.

| | |
|---|---|
| *B65H 29/14* | (2006.01) |
| *B65H 31/02* | (2006.01) |
| *B65H 31/20* | (2006.01) |
| *B65H 1/04* | (2006.01) |

(52) U.S. Cl.
CPC ..... *B65H 31/02* (2013.01); *B65H 31/20* (2013.01); *B65H 2301/4212* (2013.01); *B65H 2402/46* (2013.01); *B65H 2402/546* (2013.01); *B65H 2405/115* (2013.01); *B65H 2405/1117* (2013.01); *B65H 2405/1124* (2013.01); *B65H 2405/11172* (2013.01); *B65H 2405/121* (2013.01); *B65H 2405/324* (2013.01); *B65H 2405/33* (2013.01); *B65H 2511/20* (2013.01); *B65H 2511/51* (2013.01); *B65H 2511/515* (2013.01); *B65H 2801/12* (2013.01); *B65H 2801/15* (2013.01)

(58) Field of Classification Search
CPC ..... B65H 2405/1134; B65H 2405/115; B65H 2405/121
See application file for complete search history.

(56) References Cited

U.S. PATENT DOCUMENTS

| | | | | |
|---|---|---|---|---|
| 8,041,283 | B2 * | 10/2011 | Murai | B65H 29/70 271/188 |
| 9,203,996 | B2 * | 12/2015 | Miura | H04N 1/00519 |
| 2002/0101472 | A1 | 8/2002 | Tsuboi et al. | |
| 2003/0052956 | A1 * | 3/2003 | Katsuyama | B41J 13/103 347/108 |
| 2008/0205952 | A1 | 8/2008 | Murai | |
| 2013/0044174 | A1 | 2/2013 | Takemura et al. | |

* cited by examiner

IMAGE RECORDING APPARATUS

CROSS REFERENCE TO RELATED APPLICATION

The present application claims priority from Japanese Patent Application No. 2014-068558, which was filed on Mar. 28, 2014, the disclosure of which is herein incorporated by reference in its entirety.

BACKGROUND OF THE INVENTION

1. Field of the Invention

The present invention relates to an image recording apparatus configured to record an image on a sheet-shaped recording medium.

2. Description of Related Art

A known image forming apparatus is arranged such that, a sheet-feeder tray is provided on the front surface of the apparatus, a sheet placed on the sheet-feeder tray is supplied to an image forming portion in the apparatus, the sheet on which the recording has been done makes a U-turn, and the sheet is then discharged to a discharge tray which is also provided on the front surface side of the sheet-feeder tray. The sheet-feeder tray and the discharge tray are arranged to be openable and closable as they rotate about horizontal axes provided at lower parts thereof. The sheet-feeder tray is positioned outside the discharge tray, and the sheet-feeder tray covers the discharge tray when these trays are closed. As the sheet-feeder tray is opened, a sheet for recording can be placed on the sheet-feeder tray. When closed, the discharge tray closes a discharging slot through which a recorded sheet is discharged. When opened, the discharge tray opens the discharging slot to the outside and is able to support a sheet discharged from the discharging slot.

To record an image by such an image forming apparatus, to begin with, the sheet-feeder tray and the discharge tray are opened and a sheet for recording is placed on the sheet-feeder tray. Thereafter, as the recording of the image starts, the sheet on which the recording has been done is discharged from the discharging slot to the discharge tray.

As described above, in the image recording apparatus having a cover which is switchable between a state of closing a discharging slot to which a recorded sheet is discharged and a state of exposing the discharging slot, the cover interferes with a sheet to be discharged if the cover is in the closed state at the time of image recording, with the result that jamming may occur.

SUMMARY OF THE INVENTION

An object of the present invention is to provide an image recording apparatus in which jamming is less likely to occur.

An image recording apparatus of the present invention includes: a casing having an opening; a sheet-feeder tray having a supporting surface for supporting a sheet-shaped recording medium; a recording unit which is positioned in the casing and is configured to record an image on the recording medium fed from the sheet-feeder tray; a discharge roller pair configured to convey the recording medium on which the image has been recorded by the recording unit, in a discharge direction in which the recording medium is discharged through the opening of the casing, which opening is a discharging slot; an opening-closing member which is provided on the downstream of the discharge roller pair in the discharge direction and is rotatable between a first position where the discharging slot is closed and a second position where the discharging slot is open; and a restricting mechanism configured to restrict the rotation of the opening-closing member from the second position to the first position.

BRIEF DESCRIPTION OF THE DRAWINGS

Other and further objects, features and advantages of the invention will appear more fully from the following description taken in connection with the accompanying drawings in which:

FIG. 3A shows a state in which the tray cover is in the first position, FIG. 3B shows a state in which the tray cover is in the second position and the rotation is not restricted, and FIG. 3C shows a state in which the tray cover is in the second position and the rotation is restricted.

FIG. 4A shows a state in which the rotation of the tray cover is not restricted, whereas FIG. 4B shows a state in which the rotation of the tray cover is restricted.

DESCRIPTION OF THE PREFERRED EMBODIMENTS

The following will describe a preferred embodiment of the present invention with reference to figures.

First Embodiment

Figure 1:
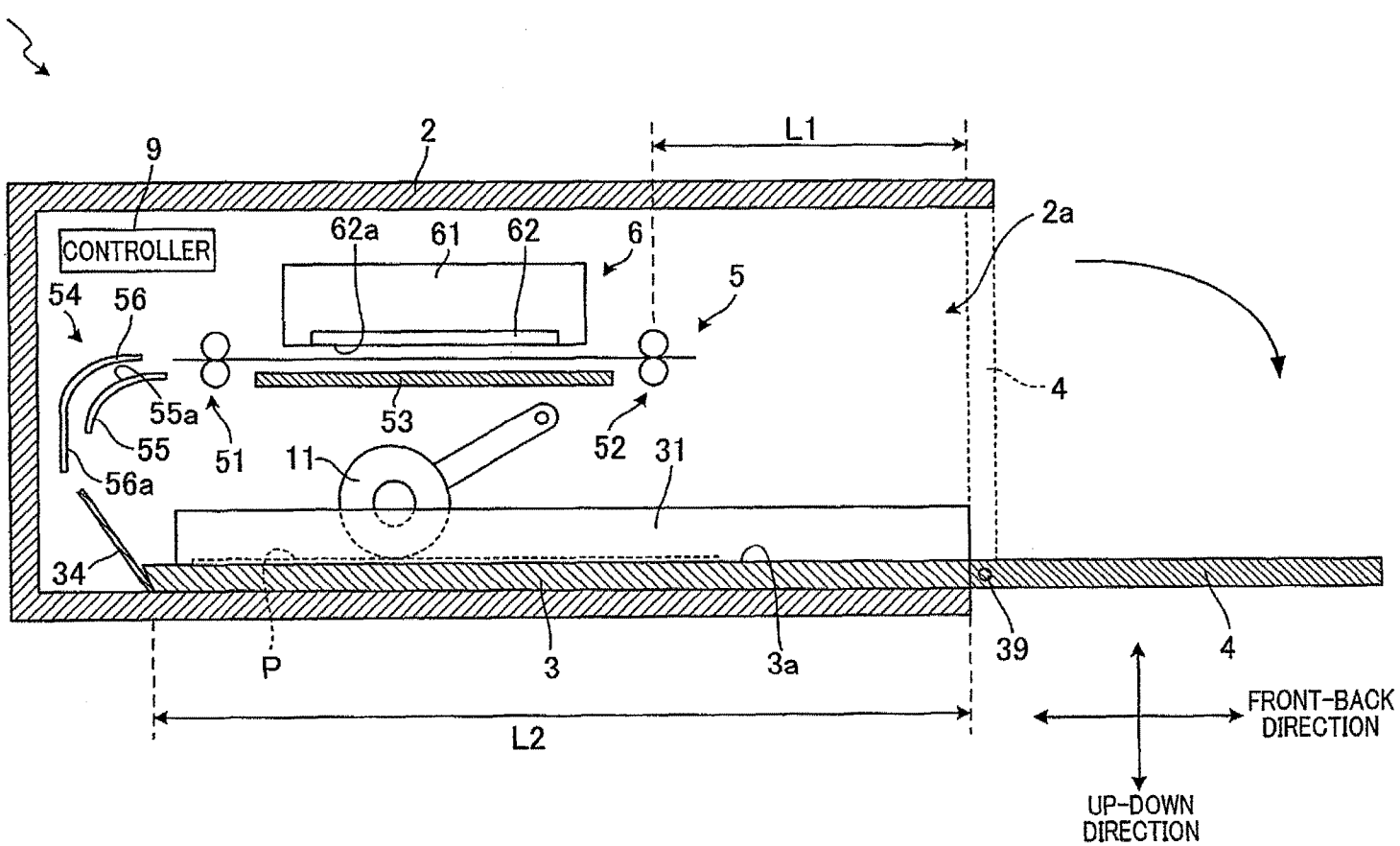
FIG. 1 is a schematic profile showing the internal structure of the inkjet printer of First Embodiment of the present invention.

Referring to FIG. 1, an inkjet printer of an embodiment of the present invention will be described. Hereinafter, the right surface of the inkjet printer 1 shown in FIG. 1 will be referred to as "front surface", whereas the left surface of the inkjet printer 1 in FIG. 1 will be referred to as "back surface". Furthermore, a direction in which the front surface and the back surface of the inkjet printer 1 oppose each other will be referred to as "front-back direction", whereas a direction which is horizontal and is orthogonal to the front-back direction will be referred to as "width direction".

As shown in FIG. 1, the inkjet printer 1 is substantially rectangular parallelepiped in shape and includes a casing 2 having an opening 2*a* on the front surface side. Through this opening 2*a*, a sheet P for recording an image is supplied and a sheet P on which an image has been recorded is discharged. To put it differently, the opening 2*a* functions as a sheet-feeder slot and a discharging slot.

At a lower part of the inside of the casing 2, a sheet-feeder tray 3 having a supporting surface 3*a* which is able to support a sheet P is provided. Above the sheet-feeder tray 3, a pickup roller 11 is provided. This pickup roller 11 is arranged to be rotatable about a rotation shaft provided in the casing 2, and is configured to send out a sheet P supported by the supporting surface 3*a* of the sheet-feeder tray 3 to the back surface side.

To the sheet-feeder tray 3, a tray cover 4 is attached by a shaft 39 which is provided at an end portion on the front surface side of the sheet-feeder tray 3. As the tray cover 4 rotates about the shaft 39, the tray cover 4 is switchable between a first position (which is indicated by broken lines in FIG. 1) where the opening 2*a* on the front surface side of the casing 2 is closed and a second position (which is indicated by full lines in FIG. 1) where the opening 2*a* is open. The height position of the leading end of the tray cover 4 is substantially identical with the height position of the top wall of the casing 2 when the tray cover 4 is in the first position, and is substantially identical with the height position of the sheet-feeder tray 3 when the tray cover 4 is in the second position.

The upper surface of the tray cover 4 in the second position is substantially flush with the supporting surface 3*a* of the sheet-feeder tray 3. When the length in the front-back direction of a sheet P supported by the sheet-feeder tray 3 is longer than a distance L2 (hereinafter, this distance L2 will be simply referred to as the length of the sheet-feeder tray 3) between an end portion on the back surface side of the sheet-feeder tray 3 (i.e., an end portion on the side from which sheets are sent) and the tray cover 4 in the first position in the direction along the supporting surface 3*a*, a part of the sheet P which part protrudes from the front edge of the sheet-feeder tray 3 is supported by the upper surface of the tray cover 4.

Figure 2:
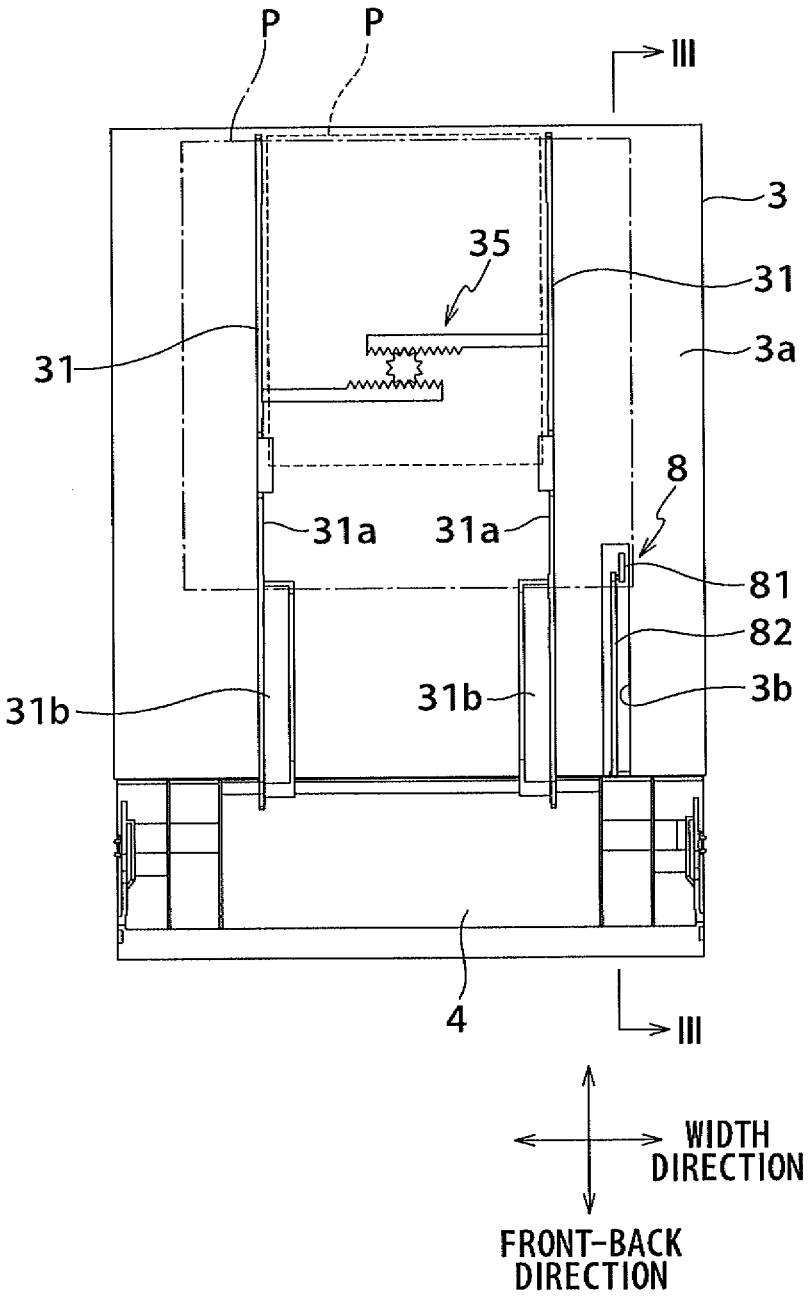
FIG. 2 is a plan view of the sheet-feeder tray and the tray cover in the second position shown in FIG. 1.

As shown in FIG. 2, the sheet-feeder tray 3 is provided with paired side guides 31 which have guide faces 31*a* by which the respective side edges of the sheet P supported by the supporting surface 3*a* are guided and a restricting mechanism 8 by which the rotation of the tray cover 4 is restricted. The details of the restricting mechanism 8 will be given later. The side guides 31 guide the sheet P so that the center in the width direction of the sheet P corresponds to the center in the width direction of the sheet-feeder tray 3. The sheet P guided by the side guides 31 is properly supported by the supporting surface 3*a* as the sheet P is postured in such a way that the direction in which the sheet P is sent out by the pickup roller 11 (i.e., the direction from the front surface side to the back surface side) is identical with the longitudinal direction of the sheet P. To handle various sizes of the sheets P supported by the sheet-feeder tray 3, the side guides 31 are arranged to be movable in the width direction (the left-right direction in FIG. 2) of the sheet P. To be more specific, a known interlocking mechanism 35 constituted by racks opposing each other and a pinion engaged with the both racks is provided, and one side guide 31 and the other side guide 31 are interlocked and moved in directions toward each other and away from each other.

In addition to the above, each of the side guides 31 includes a supporting portion 31*b* by which the sheet P on which recording has been done and has been sent toward the opening 2*a* by a later-described conveyance mechanism 5 is supported. The supporting portion 31*b* horizontally protrudes from an upper end of a part of the side guide 31 in which part the guide face 31*a* is formed, toward the guide face 31*a* (leftward in case of the right side guide 31 in FIG. 2 or rightward in case of the left side guide 31 in FIG. 2). In other words, the supporting portions 31*b* are provided above the guide faces 31*a*.

Referring back to FIG. 1, at an end portion on the back surface side of the sheet-feeder tray 3, an inclined plate 34 is attached. This inclined plate 34 is arranged such that one end is connected to an end portion on the back surface side of the sheet-feeder tray 3 whereas the other end is positioned to be closer to the back surface than the one end and above the one end. AS the pickup roller 11 is driven by an unillustrated motor, the sheets P supported by the sheet-feeder tray 3 are sent out toward the back surface side one by one, and the sheet P having been sent out is pushed upward along the inclined plate 34.

The casing 2 further houses a conveyance mechanism 5 configured to convey, toward the opening 2*a*, the sheet P sent out from the sheet-feeder tray 3 by the pickup roller 11, a recording unit 6 configured to form an image on the sheet P conveyed by the conveyance mechanism 5, and a controller 9 which is responsible for the overall control of the apparatus.

The recording unit 6 includes a carriage 61 which is reciprocated by an unillustrated moving mechanism in directions orthogonal to the plane of FIG. 1 and an inkjet head 62 mounted on the carriage 61. As the lower surface of the inkjet head 62, an ejection surface 62*a* in which ejection openings (not illustrated) configured to eject ink are formed is formed.

The conveyance mechanism 5 includes a conveyor roller pair 51 positioned to be close to the back surface as compared to the recording unit 6, a discharge roller pair 52 which is positioned to be on the opposite side of the conveyor roller pair 51 over the recording unit 6, a platen 53 which is a flat plate in shape and positioned to oppose the ejection surface 62*a* of the recording unit 6, and a curved guide 54 which guides the sheet P sent out from the sheet-feeder tray 3 by the pickup roller 11 to the conveyor roller pair 51. Each of the conveyor roller pair 51 and the discharge roller pair 52 is driven by an unillustrated motor, and the conveyor roller pair 51 and the discharge roller pair 52 convey the sheet P to the front surface side in an interval between the ejection surface 62*a* of the inkjet head 62 and the platen 53.

The curved guide 54 includes a first guide member 55 having a first guide face 55*a* which is a curved surface and a second guide member 56 having a second guide face 56*a* which is a curved surface and opposes the first guide face 55*a*. The sheet P sent out from the sheet-feeder tray 3 passes the gap between the first guide face 55*a* and the second guide face 56*a* and is guided to the conveyor roller pair 51.

With the arrangement above, the sheet P is sent out from the sheet-feeder tray 3 by the pickup roller 11 in the direction from the front surface side to the back surface side (i.e., right to left in FIG. 1) and pushed upward along the inclined plate 34, and the sheet P then makes a U-turn while being guided by the curved guide 54 and is conveyed in the direction from the back surface side to the front surface (i.e., left to right in FIG. 1). Thereafter, the sheet P is pinched by the conveyor roller pair 51 and conveyed toward the front surface, and an image is formed thereon by ink ejected from the inkjet head 62 when the sheet P is positioned to oppose the ejection surface 62*a* of the inkjet head 62. The sheet P on which the image has been recorded is conveyed toward the opening 2*a* by the discharge roller pair 52, and is supported by the supporting portions 31*b* of the side guides 31.

Now, referring further to FIG. 3A to FIG. 3C, the structure of the restricting mechanism 8 in the sheet-feeder tray 3 will be described. The restricting mechanism 8 of the present embodiment restricts the rotation of the tray cover 4 from the second position to the first position when a sheet P which is equal to or larger than a first predetermined size is supported by the sheet-feeder tray 3 and is ready to be fed (i.e., a first state in which the sheet feeding from the sheet-feeder tray 3 is likely to occur). When no sheet P is supported by the sheet-feeder tray 3 (i.e., a second state in which the sheet feeding from the sheet-feeder tray 3 is unlikely to occur as compared to the first state), the rotation of the tray cover 4 is not restricted by the restricting mechanism 8.

In regard to the above, in the conveyance direction of the conveyance mechanism 5, a sheet P with the first predetermined size is a sheet P which is shorter than the length L2 of the sheet-feeder tray 3 and is longer than a horizontal distance L1 (see FIG. 1) between the discharge roller pair 52 and the tray cover 4 which is in the first position to close the opening 2*a*. In regard to the sheet P, the present embodiment presupposes that printing on a sheet which has a regular size such as L-type, a governmental postcard size, A6, and A4 is performed in a direction in which the longitudinal direction of the sheet corresponds to the conveyance direction of the conveyance mechanism 5, and the first predetermined size is A6.

The restricting mechanism 8 includes an actuator 81 which is movable between a protruding position where the actuator 81 protrudes from the supporting surface 3*a* of the sheet-feeder tray 3 and a retracted position where the actuator 81 does not protrude from the supporting surface 3*a* and a restricting member 82 which is movable between a restricting position where the rotation of the tray cover 4 from the second position to the first position is restricted and a non-restricting position where the rotation of the tray cover 4 is not restricted.

Figure 3A:
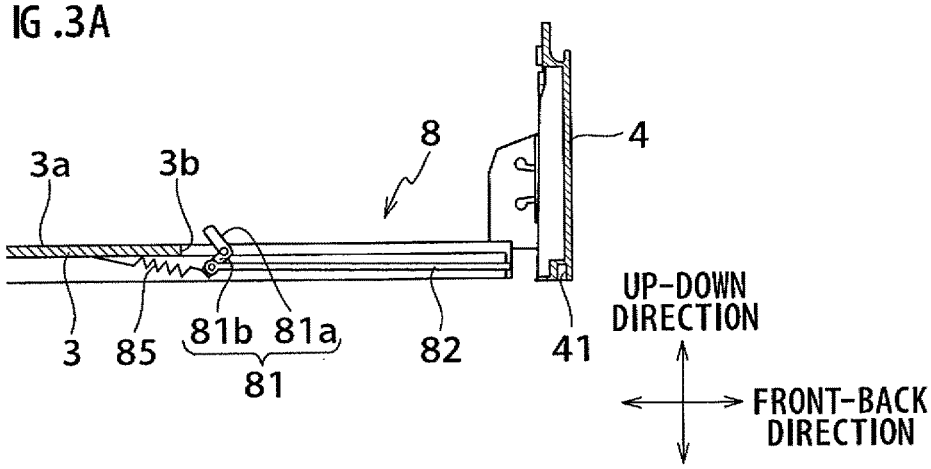
FIG. 3A to FIG. 3C are partial enlarged cross sections taken along the III-III line in FIG. 2.
Figure 3B:
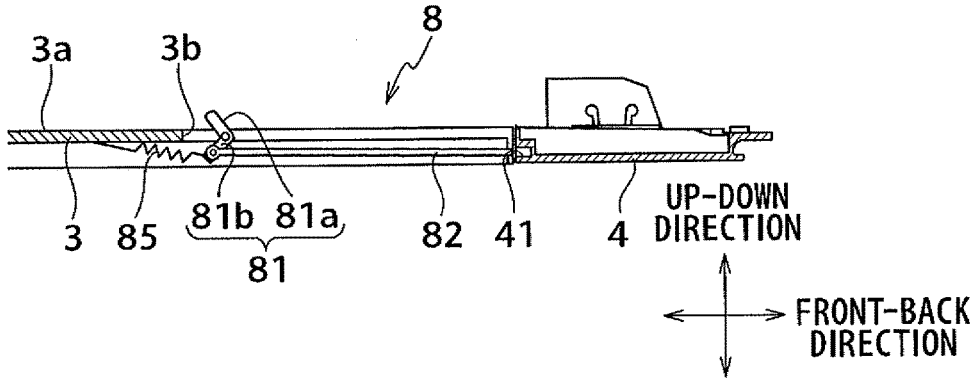
Figure 3C:
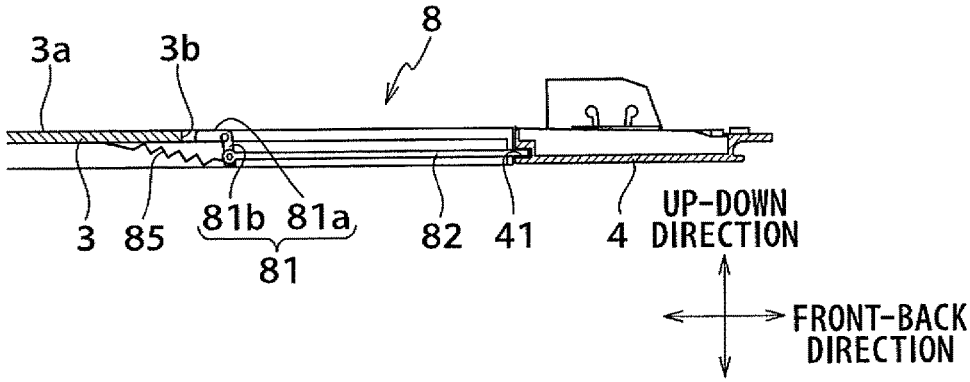

The sheet-feeder tray 3 has a through hole 3*b* which penetrates the sheet-feeder tray 3 in the up-down direction, and the actuator 81 is rotatably supported by the inner wall of the through hole 3*b* of the sheet-feeder tray 3 as shown in FIG. 3A to FIG. 3C. As shown in FIG. 2, the actuator 81 in the through hole 3*b* is, in the sheet-feeder tray 3, positioned inside a region (indicated by a dashed line) for supporting a sheet P with the first predetermined size and outside a region (indicated by a broken line) for supporting a sheet P with a second predetermined size (e.g., L-size) which is smaller than the first predetermined size.

The actuator 81 is constituted by two arm portions 81*a* and 81*b* extending from a rotational center, and is substantially V-shaped when viewed in the width direction. The actuator 81 receives a biasing force from a spring 85. When no external force is applied to the actuator 81, the arm portion 81*a* is in a protruding position to protrude upward from the supporting surface 3*a*. When an external force is applied to the actuator 81 and the leading end of the arm portion 81*a* is pushed down, the actuator 81 becomes in a retracted position so as not to protrude from the supporting surface 3*a*.

The restricting member 82 is a rod-shaped member having one end which is rotatably attached to the leading end of the arm portion 81*b* of the actuator 81, and is positioned below the sheet-feeder tray 3 to be substantially in parallel to the front-back direction. As the actuator 81 rotates, the restricting member 82 moves in the front-back direction. As shown in FIG. 3A to FIG. 3C, in the lower surface (which faces down in the first position) of the tray cover 4, a concave portion 41 is formed. As shown in FIG. 3B and FIG. 3C, when the tray cover 4 is in the second position, the concave portion 41 is positioned below the lower surface of the sheet-feeder tray 3. As the restricting member 82 moves in the front-back direction in accordance with the rotation of the actuator 81, the restricting member 82 takes a restricting position where the end portion on the front surface side (right side in each of FIG. 3A to FIG. 3C) of the restricting member 82 is engaged with the concave portion 41 of the tray cover 4 in the second position or a non-restricting position where the end portion is not engaged with the concave portion 41.

Now, the operation of the restricting mechanism 8 will be described. When recording of an image starts, to set a sheet P in the sheet-feeder tray 3, the tray cover 4 which is in the first position as shown in FIG. 3A is rotated to the second position as shown in FIG. 3B. Until a sheet P is placed on the sheet-feeder tray 3, the actuator 81 is in the protruding position on account of the biasing force of the spring 85. At this stage, the restricting member 82 is not engaged with the concave portion 41 of the tray cover 4 at the end portion on the front surface side, and hence the tray cover 4 is rotatable.

When a sheet P which is equal to or larger than the first predetermined size is placed on the sheet-feeder tray 3, the actuator 81 in the protruding position is pushed downward by the sheet P and is therefore moved to the retracted position as shown in FIG. 3C. As the actuator 81 is moved to the retracted position, the end portion on the front surface side of the restricting member 82 is engaged with the concave portion 41 of the tray cover 4, with the result that the rotation of the tray cover 4 from the second position to the first position is restricted.

As described above, in the inkjet printer 1 of the present embodiment, the opening 2*a* which is the discharging slot for the sheet P discharged by the discharge roller pair 52 is formed. The tray cover 4 which is on the downstream of the discharge roller pair 52 in the direction in which the sheet P is discharged by the discharge roller pair 52 (left to right in FIG. 1) is rotatable between the first position where the opening 2*a* is closed and the second position where the opening 2*a* is open. The restricting mechanism 8 restricts the rotation of the tray cover 4 from the second position to the first position. This makes it possible to restrain the occurrence of jamming due to interference of the sheet P fed from the sheet-feeder tray 3 and discharged by the discharge roller pair 52 with the tray cover 4 in the first position.

The restricting mechanism 8 restricts the rotation of the tray cover 4 from the second position to the first position when the sheet-feeder tray 3 supports a sheet P. This makes it possible to restrain the occurrence of jamming due to interference of the sheet P with the tray cover 4 in the first position when the sheet P supported by the sheet-feeder tray 3 is fed and discharged by the discharge roller pair 52.

In addition to the above, the tray cover 4 of the present embodiment is rotatably attached to the sheet-feeder tray 3 and is able to support a sheet P supplied to the recording unit 6 when the tray cover 4 is in the second position. When the tray cover 4 in the second position is rotated while the tray cover 4 is supporting a sheet P, the sheet P may be bended. In this regard, such bending of the sheet P is prevented because the restricting mechanism 8 restricts the rotation of the tray cover 4.

In addition to the above, the tray cover 4 of the present embodiment closes the opening 2*a* which is a sheet-feeder slot allowing the sheet-feeder tray 3 to support a record sheet when the tray cover 4 is in the first position, and opens the opening 2*a* when the tray cover 4 is in the second position. It is therefore necessary to rotate the tray cover 4 to the second position in order to set a sheet P in the sheet-feeder tray 3. Thereafter, the restricting mechanism 8 restricts the rotation of the tray cover 4 from the second position to the first position.

In addition to the above, the restricting mechanism 8 of the present embodiment includes the actuator 81 which is movable between the protruding position where the actuator 81 protrudes from the supporting surface 3*a* of the sheet-feeder tray 3 supporting the sheet P and the retracted position where the actuator 81 does not protrude from the supporting surface 3*a* and the restricting member 82 which is movable between the restricting position where the rotation of the tray cover 4 from the second position to the first position is restricted and the non-restricting position where the rotation of the tray cover 4 is not restricted. The restricting member 82 moves in accordance with the movement of the actuator 81, and is in the non-restricting position when the actuator 81 is in the protruding position, and is in the restricting position when the actuator 81 is in the refracted position. For this reason, when the sheet-feeder tray 3 supports a sheet P, the actuator 81 is in the retracted position where the actuator 81 does not protrude from the supporting surface 3*a* of the sheet-feeder tray 3 and the restricting member 82 is in the restricting position where the rotation of the tray cover 4 to the first position is restricted. As such, when a sheet P is supported by the sheet-feeder tray 3, the rotation of the tray cover 4 to the first position is restricted.

In addition to the above, in the restricting mechanism 8 of the present embodiment, the actuator 81 is biased toward the protruding position. On this account, when there becomes no sheet P on the sheet-feeder tray 3, the actuator 81 moves to the protruding position and hence the restricting member 82 moves to the non-restricting position. With this, it becomes possible to return the tray cover 4 to the first position.

Furthermore, in the restricting mechanism 8 of the present embodiment, the actuator 81 is positioned inside a region of the sheet-feeder tray 3 for supporting a sheet P with the first predetermined size and outside a region for supporting a sheet P with the second predetermined size which is smaller than the first predetermined size. On this account, when the sheet P supported by the sheet-feeder tray 3 is smaller than the second predetermined size, the actuator 81 does not move to the retracted position. When the sheet P is equal to or larger than the first predetermined size, the actuator 81 moves to the refracted position and the restricting member 82 moves to the restricting position, with the result that the state in which the rotation of the tray cover 4 to the first position is restricted is established.

In addition to the above, in the inkjet printer 1 of the present embodiment, the length of the sheet P with the first predetermined size is longer than the horizontal distance L1 between the discharge roller pair 52 and the tray cover 4 in the first position. When the length of the sheet P is longer than the distance L1, the sheet P discharged by the discharge roller pair 52 interferes with the tray cover 4 and jamming occurs, if the tray cover 4 is in the first position. In the present embodiment, when a sheet P which is equal to or larger than the first predetermined size with which jamming may occur is supported by the sheet-feeder tray 3, the rotation of the tray cover 4 to the first position is restricted.

In addition to the above, in the inkjet printer 1 of the present embodiment, the length of the sheet P with the first predetermined size is shorter than the length L2 of the sheet-feeder tray 3. When a sheet P shorter than the length L2 is supported by the sheet-feeder tray 3, the sheet P is not supported by the tray cover 4 in the second position. On this account, in regard to a problem that the tray cover 4 in the second position tends to be erroneously rotated to the first position, the restricting mechanism 8 restricts the rotation of the tray cover 4 to the first position in such a case.

Furthermore, in the present embodiment, each side guide 31 includes the supporting portion 31*b* which is provided above the guide face 31*a* and supports the sheet P discharged by the discharge roller pair 52. This makes it possible to mount a recorded sheet P on the sheet-feeder tray 3 from above.

Second Embodiment

Figure 4A:
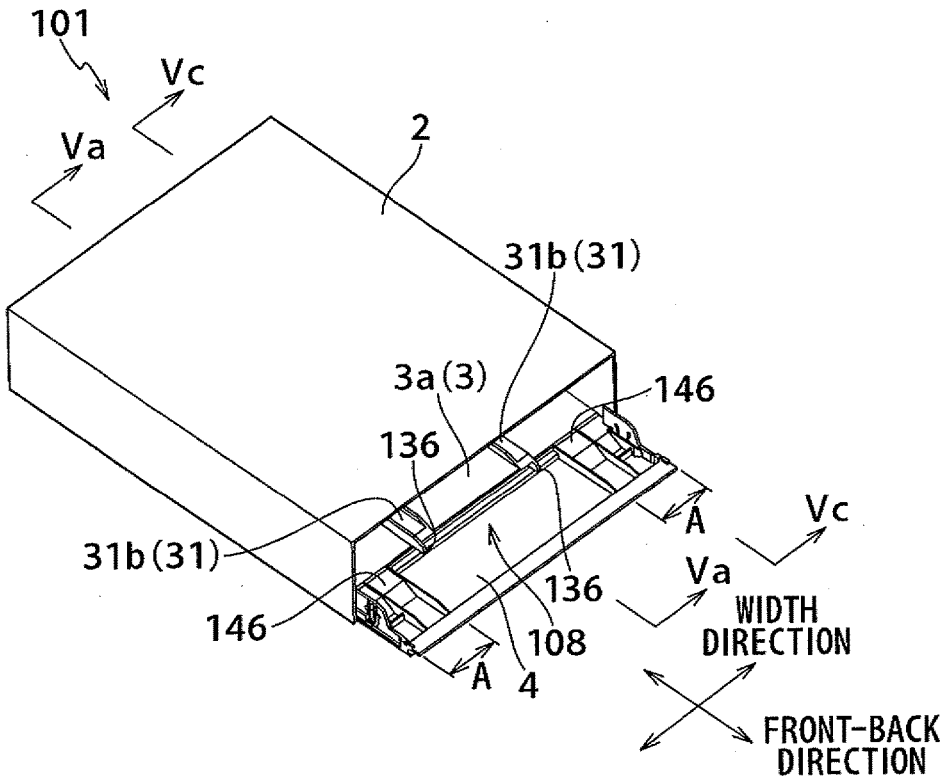
FIG. 4A and FIG. 4B are oblique perspectives of the external appearance of an inkjet printer of Second Embodiment of the present invention.

The following will describe Second Embodiment of the present invention with reference to FIG. 4A, FIG. 4B, and FIG. 5A to FIG. 5C. Second Embodiment is chiefly different from First Embodiment in the structure of the restricting mechanism. In the present embodiment, members identical with those in First Embodiment will be denoted by the same reference numerals and the descriptions thereof will be suitably omitted. The Va-Va line in FIG. 4A is a section line in a region other than later-described regions A, whereas the Vc-Vc is a section line in the region A.

A restricting mechanism 108 of an inkjet printer 101 of the present embodiment restricts the rotation of the tray cover 4 from the second position to the first position, when a preparation operation of moving the side guides 31 in the width direction in accordance with the size of the sheet P is performed in order to allow the sheet P to be suitably supported by the sheet-feeder tray 3 and the sheet P is ready to be fed (i.e., a first state in which the sheet feeding from the sheet-feeder tray 3 is likely to occur). When such a preparation operation has not been done (i.e., a second state in which the sheet feeding from the sheet-feeder tray 3 is unlikely to occur as compared to the first state), the restriction of the rotation of the tray cover 4 by the restricting mechanism 108 is not performed. To be more specific, when the paired side guides 31 are in the regions A (see FIG. 4A), the rotation of the tray cover 4 from the second position to the first position is restricted.

The sheet P guided by the side guides 31 in the regions A has at least a predetermined size. In this regard, the sheet P with the predetermined size is longer in the conveyance direction than the horizontal distance L1 between the discharge roller pair 52 and the tray cover 4 which is in the first position and closes the opening 2*a*. In other words, the sheet P guided by the side guides 31 in the regions A is longer than the distance L1. In the present embodiment, the predetermined size is A6.

A restricting mechanism 108 is provided on the side guides 31 and has engaging portions 136 which are capable of being engaged with the tray cover 4. Each engaging portion 136 is an end portion on the front surface side of the side guide 31, and protrudes toward the front surface from an end portion on the front surface side of the sheet-feeder tray 3.

Figure 4B:
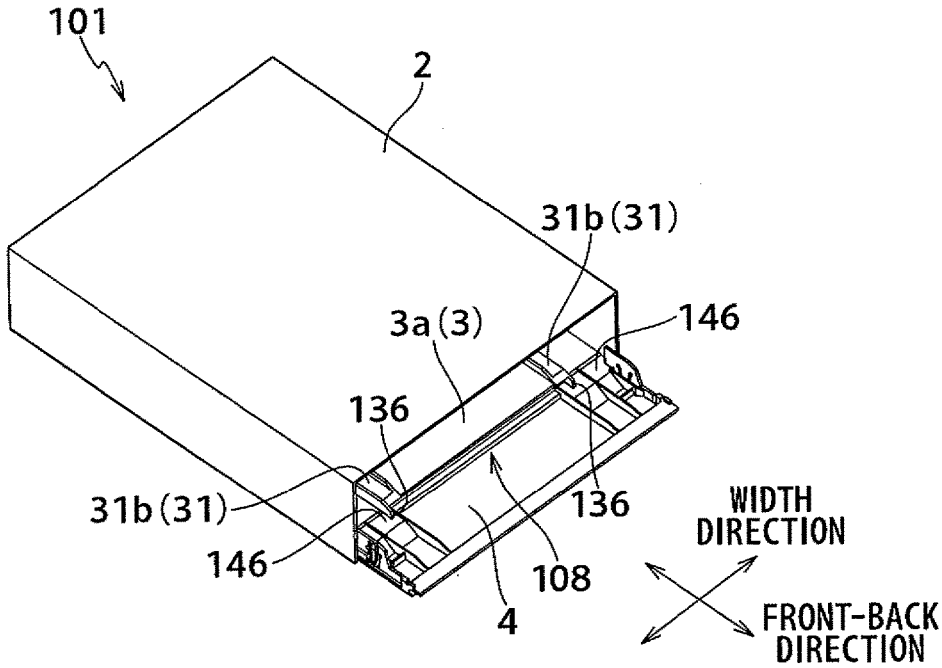
Figure 5A:
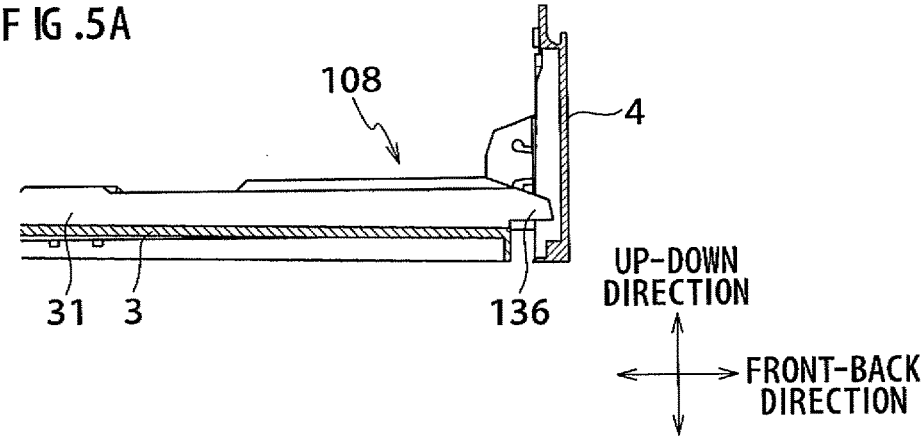
FIG. 5A is a cross section taken at the Va-Va line in FIG. 4A, and shows a state in which the tray cover is in the first position.
Figure 5B:
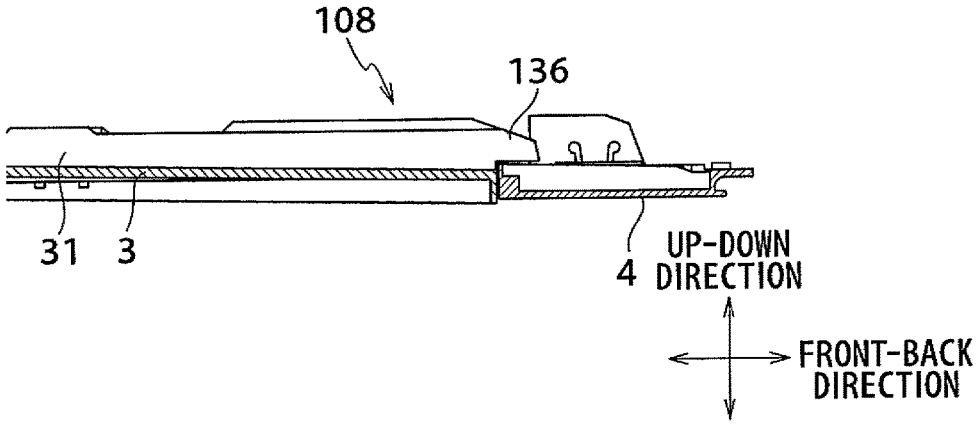
FIG. 5B is a cross section taken at the Va-Va line in FIG. 4A, and shows a state in which the tray cover is in the second position and the rotation thereof is not restricted.
Figure 5C:
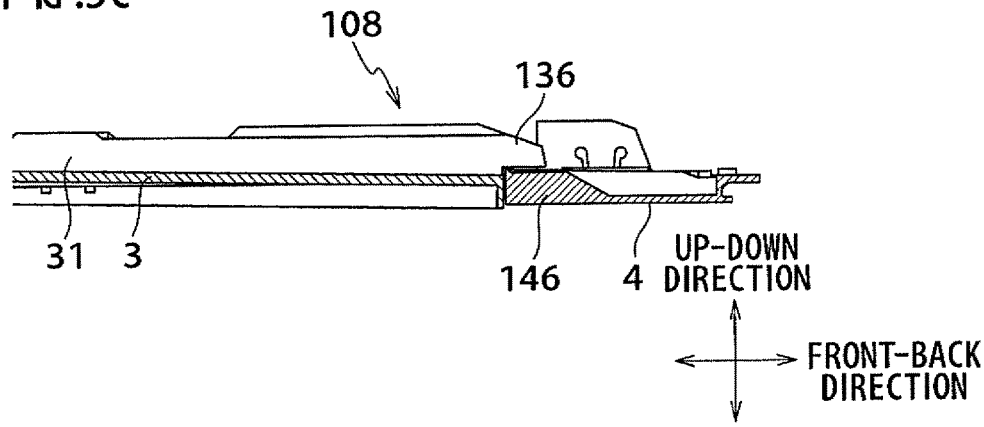
FIG. 5C is a cross section taken at the Vc-Vc line in FIG. 4A, and shows a state in which the tray cover is in the second position and the rotation thereof is restricted.

In the tray cover 4, engaged portions 146 to be engaged with the engaging portions 136 of the side guides 31 are provided at an end portion on the sheet-feeder tray 3 side of a surface of the tray cover 4 which faces up when the tray cover 4 is in the second position and the opening 2*a* is open. As shown in FIG. 5C, the upper surface of the tray cover 4 in the second position swells at a part where the engaged portions 146 are formed. As shown in FIG. 4A and FIG. 4B, the engaged portions 146 are provided at end portions in the width direction of the tray cover 4 in the second position, respectively. These engaged portions 146 are engaged with the engaging portions 136 of the side guides 31, when the side guides 31 are in the regions A to guide the respective ends in the width direction of a sheet P which has at least the predetermined size.

Now, the operation of the restricting mechanism 108 will be described. When recording of an image starts, to set a sheet P in the sheet-feeder tray 3, the tray cover 4 which is in the first position as shown in FIG. 5A is rotated to the second position as shown in FIG. 5B. At this stage, as shown in FIG. 4A, the side guides 31 are positioned on the inner side in the width direction of the positions (regions A) at which end portions in the width direction of a sheet P which is equal to or larger than a predetermined size are guided, and the engaging portions 136 of the side guides 31 are not engaged with the engaged portions 146 of the tray cover 4 and hence the tray cover 4 is rotatable.

Subsequently, the preparation operation is performed to move the side guides 31 in the width direction in accordance with the size of the sheet P in order to cause the sheet-feeder tray 3 to properly support the sheet P. When the side guides 31 are positioned in the regions A, as shown in FIG. 4B and FIG. 5C, the engaging portions 136 are engaged with the engaged portions 146 of the tray cover 4. At this stage, the rotation of the tray cover 4 from the second position to the first position is restricted.

As described above, in the inkjet printer 101 of the present embodiment, the restricting mechanism 108 is provided on the side guides 31, and includes engaging portions 136 which are engaged with the engaged portions 146 of the tray cover 4 in the second position when the side guides 31 are in the predetermined regions A and are not engaged with the engaged portions 146 when the side guides 31 are not in the regions A. For this reason, as the side guides 31 are moved to be positioned in the regions A at the time of setting a sheet P in the sheet-feeder tray 3, the engaging portions 136 are engaged with the engaged portions 146 of the tray cover 4, and hence the rotation of the tray cover 4 from the second position to the first position is restricted.

In addition to the above, in the present embodiment, the regions A are regions at which a sheet P which is equal to or larger than the predetermined size is guided on the sheet-feeder tray 3. For this reason, when the side guides 31 are positioned in regions at which side edges of a sheet P which is supported by the sheet-feeder tray 3 and is equal to or larger than the predetermined size are guided, the engaging portions 136 of the side guides 31 are engaged with the engaged portions 146 of the tray cover 4, with the result that the rotation of the tray cover 4 to the first position is restricted.

Third Embodiment

Figure 6:
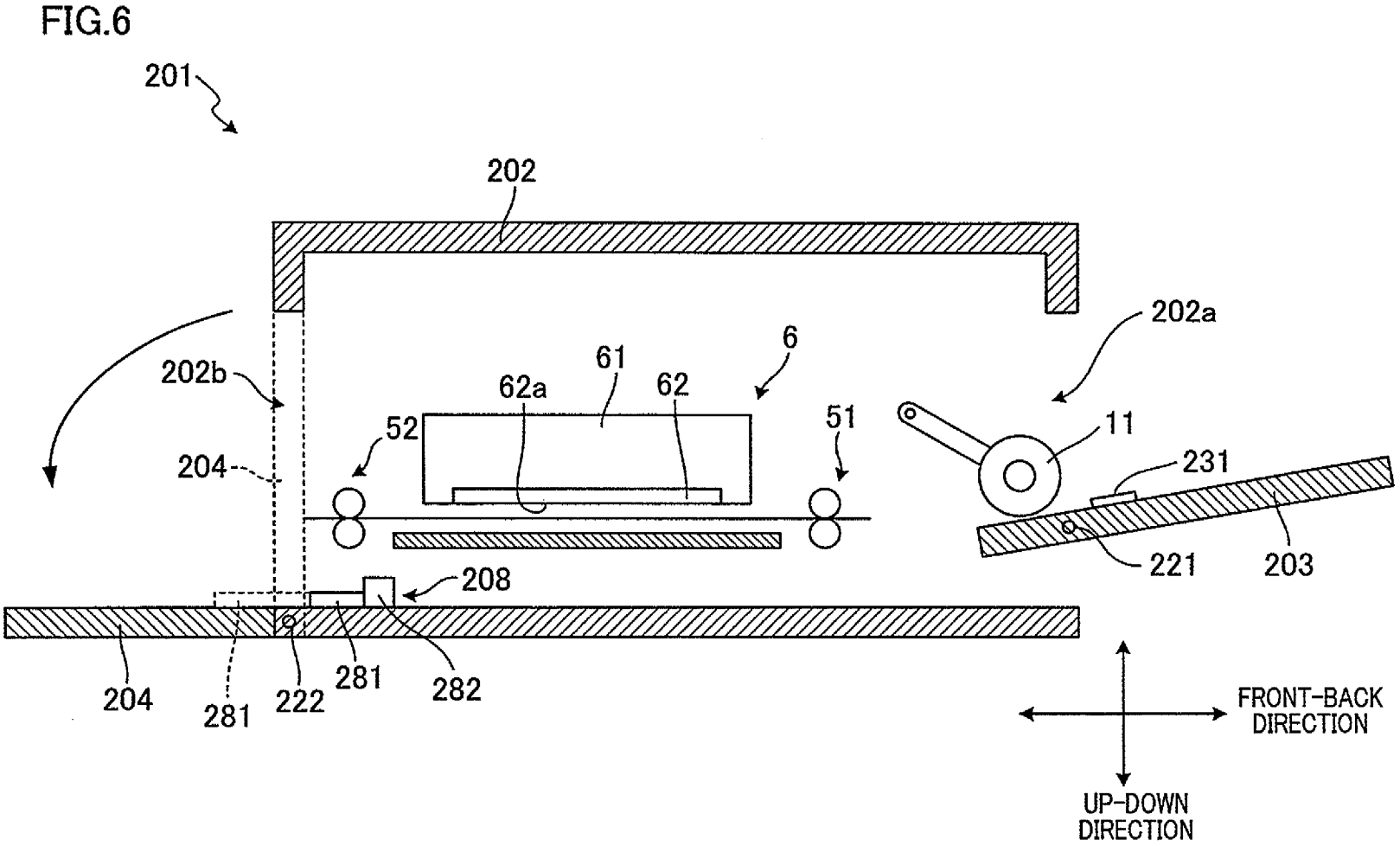
FIG. 6 is a schematic profile showing the internal structure of an inkjet printer of Third Embodiment of the present invention.

The following will describe Third Embodiment of the present invention with reference to FIG. 6. Third Embodiment is chiefly different from First Embodiment in that, while in First Embodiment the sheet P sent out from the sheet-feeder tray 3 makes a U-turn in the casing 2, in the present embodiment a sheet P does not make a U-turn in a casing 202. In the present embodiment, members identical with those in First Embodiment will be denoted by the same reference numerals and the descriptions thereof will be suitably omitted.

In a casing 202 of an inkjet printer 201 of the present embodiment, a sheet-feeder slot 202*a* is formed on the front surface side (right side in FIG. 6) to allow a sheet-feeder tray 203 to support a sheet P, and a discharging slot 202*b* through which the sheet P is discharged by the discharge roller pair 52 is formed on the back surface side (left side in FIG. 6). In the sheet-feeder slot 202*a*, the sheet-feeder tray 203 is rotatably supported by a shaft 221 which is attached to the casing 202. As the sheet-feeder tray 203 rotates about the shaft 221, the sheet-feeder tray 203 is switchable between a position where the sheet-feeder slot 202*a* is closed and a position where the sheet-feeder slot 202*a* is open. In the discharging slot 202*b*, the discharge tray 204 is rotatably supported by a shaft 222 which is attached to a lower end portion on the back surface side of the casing 202. As the discharge tray 204 rotates about the shaft 222, the discharge tray 204 is switchable between a first position (indicated by broken lines in FIG. 6) where the discharging slot 202*b* is closed and a second position (indicated by full lines in FIG. 6) where the discharging slot 202*b* is open. The height position of the leading end of the discharge tray 204 is above the nipping position of the discharge roller pair 52 when the discharge tray 204 is in the first position, and is substantially as high as the bottom wall of the casing 202 when the discharge tray 204 is in the second position.

With the arrangement above, a sheet P sent out from the sheet-feeder tray 203 by the pickup roller 11 in a direction from the front surface side to the back surface side (right to left in FIG. 6) is pinched by the conveyor roller pair 51 of the conveyance mechanism 5 and conveyed further toward the back surface, and an image is formed on the sheet P by ink ejected from the inkjet head 62 at a position where the sheet P opposes the ejection surface 62*a* of the inkjet head 62. The sheet P on which the image has been formed is conveyed toward the discharging slot 202*b* by the discharge roller pair 52 and is supported by the discharge tray 204.

In the sheet-feeder tray 203, a sensor 231 is provided to detect whether the sheet-feeder tray 203 supports a sheet P. In addition to the above, in the vicinity of the discharging slot 202*b* in the casing 202, a restricting mechanism 208 is provided to restrict the rotation of the discharge tray 204. The restricting mechanism 208 includes a rod-shaped restricting member 281 which is positioned so that the longitudinal direction thereof is in parallel to the front-back direction (left-right direction in FIG. 6) on the bottom wall of the casing 202 and a drive unit 282 such as a solenoid which is configured to drive the restricting member 281 forward and backward in the front-back directions.

When the sensor 231 does not detect that the sheet-feeder tray 203 supports a sheet P, the restricting member 281 is in a non-restricting position (indicated by a full line in FIG. 6) in which an end portion on the back surface side of the restricting member 281 is in the casing 202. When the sensor 231 detects that the sheet-feeder tray 203 supports a sheet P, the drive unit 282 moves the restricting member 281 toward the back surface side (leftward in FIG. 6) in response to an instruction from the controller 9. As a result, the restricting member 281 becomes in a restricting position (indicated by a broken line in FIG. 6) in which an end portion on the back surface side of the restricting member 281 juts out from the casing 202 through the discharging slot 202*b*.

If the discharge tray 204 is in the first position when the sensor 231 detects that the sheet-feeder tray 203 supports the sheet P, the discharge tray 204 is rotated to the second position as the discharge tray 204 is pressed by the restricting member 281 which is moving from the non-restricting position to the restricting position. In other words, the restricting mechanism 208 functions as a rotation mechanism of rotating the discharge tray 204 from the first position to the second position.

As described above, the inkjet printer 201 of the present embodiment includes the restricting mechanism 208 which is configured to rotate the discharge tray 204 from the first position where the discharging slot 202*b* is closed to the second position where the discharging slot 202*b* is open, when a sheet P is placed on the sheet-feeder tray 203. With this, because the discharge tray 204 is arranged to be in the second position when a sheet P is placed on the sheet-feeder tray 203 in a preparation process before the start of image recording, it is possible to prevent the occurrence of jamming due to the start of image recording even if the discharge tray 204 is still in the first position.

In addition to the above, in the present embodiment, the sensor 231 for detecting whether the sheet-feeder tray 203 supports a sheet P is provided, and the restricting mechanism 208 restricts the rotation of the discharge tray 204 from the second position to the first position when the sensor 231 detects that the sheet-feeder tray 203 supports a sheet P. This makes it possible to restrict the rotation of the discharge tray 204 to the first position when the sheet-feeder tray 203 supports a sheet P.

While a preferred embodiment of the invention has been described, the present invention is not limited to the embodiments and modifications above, and it is evident that many alternatives, modifications and variations will be apparent to those skilled in the art, within the scope of the claims.

In First to Third Embodiments, the tray cover 4 (discharge tray 204) which is rotatable between the first position where the opening 2*a* (discharging slot 202*b*) functioning as a discharging slot is closed and the second position where the opening 2*a* is open is rotatable with respect to the shaft 39 (222) provided below the nipping position of the discharge roller pair 52, and in the first position the leading end of the tray cover 4 is above the nipping position whereas in the second position the leading end of the tray cover 4 is below the nipping position. The disclosure, however, is not limited to this arrangement. For example, in place of the tray cover 4 or the discharge tray 204, an opening-closing member which is rotatable about a shaft provided above the nipping position of the discharge roller pair 52 and is switchable between a position where the discharging slot is closed and a position where the discharging slot is open may be provided.

In addition to the above, while in First and Second Embodiments the restricting mechanism 8 (108) restricts the rotation of the tray cover 4 to the first position by the mechanical structure, the disclosure is not limited to this arrangement. For example, whether the sheet-feeder tray 3 supports a recording medium or whether the side guides 31 are in the predetermined regions A is detected by a sensor or the like, and the rotation of the tray cover 4 to the first position is restricted based on a detection signal from the sensor or the like.

In addition to the above, while in First and Second Embodiments the tray cover 4 is attached to the sheet-feeder tray 3, the tray cover 4 may be attached to the casing 2.

In addition to the above, while in First Embodiment above the actuator 81 is biased toward the protruding position, the actuator 81 may not be biased.

In addition to the above, while in First Embodiment the actuator 81 is positioned outside the region on the sheet-feeder tray 3 where a sheet P smaller than the predetermined size is supported and the rotation of the tray cover 4 is restricted by the restricting mechanism 8 when the sheet-feeder tray 3 supports a sheet P which is equal to or larger than the predetermined size, the disclosure is not limited to this arrangement. For example, the actuator 81 is provided at the center in the width direction of the sheet-feeder tray 3, and the rotation of the tray cover 4 is restricted when the sheet-feeder tray 3 supports a sheet P, irrespective of the size of the sheet P.

In addition to the above, while in First and Second Embodiments the length of the sheet P with the first predetermined size (predetermined size) is longer than the horizontal distance L1 between the discharge roller pair 52 and the tray cover 4 in the first position, the length of the sheet P with the predetermined size may be equal to or shorter than the distance L1.

In addition to the above, while First Embodiment describes a case where the length of the sheet P with the predetermined size is shorter than the length L2 of the sheet-feeder tray 3, the sheet P with the predetermined size may be equal to or longer than the length L2. When the sheet P is rolled, the sheet P is not supported by the tray cover 4 in the second position even if the length of the sheet P is equal to or longer than the length L2 of the sheet-feeder tray 3, and the problem that the tray cover 4 in the second position is mistakenly rotated to the first position may occur.

In addition to the above, while in the First and Second Embodiments the paired side guides 31 guide the respective side edges of the sheet P and the center in the width direction of the sheet P is arranged to correspond to the center in the width direction of the sheet-feeder tray 3, the disclosure is not limited to this arrangement. For example, one side edge in the width direction of the sheet P supported by the sheet-feeder tray 3 may correspond to an end portion in the width direction of the sheet-feeder tray 3, and the side guide 31 may guide the other side edge in the width direction of the sheet P.

In addition to the above, while in First and Second Embodiments the side guides 31 have the supporting portions 31*b* by which the sheet P discharged by the discharge roller pair 52 is supported, the supporting portions 31*b* may be provided in a member different from the side guides 31.

In addition to the above, while in Second Embodiment the regions A in which the side guides 31 are positioned when the rotation of the tray cover 4 is restricted are, in the sheet-feeder tray 3, regions where a sheet P which is longer in the conveyance direction than the horizontal distance L1 between the discharge roller pair 52 and the tray cover 4 in the first position is guided, the disclosure is not limited to this arrangement. For example, regions other than a central region in the width direction of the sheet-feeder tray 3 are set as the regions A, and the rotation of the tray cover 4 is always restricted except when the side guides 31 are at the center of the sheet-feeder tray 3. Furthermore, the regions A may be positions of the side guides 31 that guide a sheet P which is longer in the conveyance direction than the distance L1 and shorter than the length L2 of the sheet-feeder tray 3.

In addition to the above, while in Third Embodiment the sensor 231 for detecting whether the sheet-feeder tray 203 supports a sheet P is provided in the sheet-feeder tray 203, the sensor 231 may be provided in a member other than the sheet-feeder tray 203.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a casing having an opening;

a sheet-feeder tray having a supporting surface for supporting a sheet-shaped recording medium;

a recording unit which is positioned in the casing and is configured to record an image on the recording medium fed from the sheet-feeder tray;

a discharge roller pair configured to convey the recording medium on which the image has been recorded by the recording unit, in a discharge direction in which the recording medium is discharged through the opening of the casing, which opening is a discharging slot;

an opening-closing member which is provided on the downstream of the discharge roller pair in the discharge direction and is rotatable between a first position where the discharging slot is closed and a second position where the discharging slot is open; and a restricting mechanism configured to restrict the rotation of the opening-closing member from the second position to the first position, wherein, the opening-closing member is able to support the recording medium which is to be fed to the recording unit when the opening-closing member is in the second position, and the restricting mechanism includes:

an actuator which is movable between a protruding position where the actuator protrudes from the supporting surface of the sheet-feeder tray and a retracted position where the actuator does not protrude from the supporting surface; and a restricting member which is movable between a restricting position where the rotation of the opening-closing member from the second position to the first position is restricted and a non-restricting position where the rotation of the opening-closing member from the second position to the first position is not restricted, the restricting member moving in accordance with movement of the actuator, and being in the non-restricting position when the actuator is in the protruding position whereas being in the restricting position when the actuator is in the retracted position.

2. The image recording apparatus according to claim 1, wherein, when the sheet-feeder tray is in a state of being ready to feed the recording medium, the restricting mechanism restricts the rotation of the opening-closing member from the second position to the first position.

3. The image recording apparatus according to claim 1, wherein, the opening-closing member is rotatably attached to the sheet-feeder tray.

4. The image recording apparatus according to claim 1, wherein, the opening-closing member in the first position closes a sheet-feeder slot through which the recording medium is supplied onto the sheet-feeder tray and the opening-closing member in the second position opens the sheet-feeder slot.

5. The image recording apparatus according to claim 1, wherein, the actuator being biased toward the protruding position.

6. The image recording apparatus according to claim 1, wherein, the actuator is positioned inside a first region on the sheet-feeder tray configured to support the recording medium having a first predetermined size, and the actuator is positioned outside a second region on the sheet-feeder tray configured to support the recording medium having a second predetermined size which is smaller than the first predetermined size.

7. The image recording apparatus according to claim 6, wherein, the length of the recording medium with the first predetermined size is longer than a horizontal distance between the discharge roller pair and the opening-closing member in the first position.

8. The image recording apparatus according to claim 7, wherein, the length of the recording medium with the first predetermined size is longer than a distance along the supporting surface between an end portion of the sheet-feeder tray in the direction in which the recording medium is fed and the opening-closing member in the first position.

9. The image recording apparatus according to claim 1, further comprising a side guide which has a guide face capable of guiding a side edge of the recording medium supported by the sheet-feeder tray and is movable in a width direction of the recording medium supported by the sheet-feeder tray, the side guide includes a supporting portion which is provided above the guide face and supports the recording medium discharged by the discharge roller pair.

10. The image recording apparatus according to claim 1, further comprising a rotation mechanism which is configured to rotate the opening-closing member from the first position to the second position when the recording medium is placed on the sheet-feeder tray.

11. The image recording apparatus according to claim 1, further comprising a detection unit configured to detect whether the recording medium is supported on the sheet-feeder tray, when the detection unit detects that the recording medium is supported on the sheet-feeder tray, the restricting mechanism restricts the rotation of the opening-closing member from the second position to the first position.

12. An image recording apparatus, comprising:

a casing having an opening;

a sheet-feeder tray having a supporting surface for supporting a sheet-shaped recording medium;

a recording unit which is positioned in the casing and is configured to record an image on the recording medium fed from the sheet-feeder tray;

a discharge roller configured to convey the recording medium on which the image has been recorded by the recording unit, in a discharge direction in which the recording medium is discharged through the opening of the casing, which opening is a discharging slot;

an opening-closing member which is provided on the downstream of the discharge roller pair in the discharge direction and is rotatable between a first position where the discharging slot is closed and a second position where the discharging slot is open; and a restricting mechanism configured to restrict the rotation of the opening-closing member from the second position to the first position, wherein the opening-closing member is able to support the recording medium which is to be fed to the recording unit when the opening-closing member is in the second position, and the restricting mechanism includes:

a side guide which has a guide face capable of guiding a side edge of the recording medium supported by the sheet-feeder tray and is movable in a width direction of the recording medium supported by the sheet-feeder tray; and an engaging portion which is provided in the side guide and is configured to be engaged with the opening-closing member in the second position when the side guide is positioned in a predetermined region and not to be engaged with the opening-closing member in the second position when the side guide is positioned outside the predetermined region.

13. The image recording apparatus according to claim 12, wherein, the predetermined region includes a position of the side guide guiding the recording medium with a predetermined size on the sheet-feeder tray, and the length of the recording medium with the predetermined size is longer than a horizontal distance between the discharge roller pair and the opening-closing member in the first position.

14. The image recording apparatus according to claim 13, wherein, the length of the recording medium with the predetermined size is shorter than a distance along the supporting surface between an end portion of the sheet-feeder tray in the direction in which the recording medium is fed and the opening-closing member in the first position.

15. The image recording apparatus according to claim 12, wherein, the side guide includes a supporting portion which is provided above the guide face and supports the recording medium discharged by the discharge roller pair.

* * * * *